US006994659B2

(12) United States Patent
Kras

(10) Patent No.: US 6,994,659 B2
(45) Date of Patent: Feb. 7, 2006

(54) APPARATUS FOR PERFORMING POWER EXERCISES

(76) Inventor: Ralf Edgar Kras, Wandelpad 56, Hilversum (NL), 1211 GP ( * ) Notice: Subject to any disclaimer, the term of this patent is extended or adjusted under 35 U.S.C. 154(b) by 346 days.

(21) Appl. No.: 10/133,880

(22) Filed: Apr. 26, 2002

(65) Prior Publication Data

US 2002/0169055 A1 Nov. 14, 2002

(30) Foreign Application Priority Data

Apr. 26, 2001 (NL) ..... 1017950

(51) Int. Cl.
*A63B 21/00* (2006.01)

(52) U.S. Cl. ..... 482/92; 482/111; 482/112

(58) Field of Classification Search ..... 482/5, 482/8, 93, 94, 97, 98, 108, 110–113, 1, 2, 482/104

See application file for complete search history.

(56) References Cited

U.S. PATENT DOCUMENTS 4,050,310 A * 9/1977 Keiser ..... 482/2
4,799,672 A * 1/1989 Barrett ..... 482/104
5,542,897 A * 8/1996 Hall ..... 482/111
5,842,957 A * 12/1998 Wheeler ..... 482/111
6,447,431 B1 * 9/2002 Milburn et al. ..... 482/98

* cited by examiner

*Primary Examiner*—Glenn E. Richman
(74) *Attorney, Agent, or Firm*—McDonnell Boehnen Hulbert & Berghoff LLP

(57) ABSTRACT

Described is an apparatus for performing power exercises with one or more weights, wherein a weight consists of a reservoir for filling with liquid and/or air. This reservoir, referred to below as weight reservoir, serves as weight resistance for a power exercise and is connected by means of a flexible liquid conduit to a liquid displacing device. This liquid displacing device can carry liquid into the weight reservoir and remove it from the weight reservoir, whereby the weight of the weight reservoir, and thus the resistance of the power exercise, becomes greater or smaller.

The operation of this liquid displacing device can be carried out by the user while performing the exercise in order to adjust the weight to his or her wishes without having to interrupt the power exercise for this purpose.

The invention can be applied to power exercises with free weights and power exercises wherein the weight reservoir is provided with a conducting device. A buffer tank and dumbbell suitable for application in such an apparatus also form an aspect of the invention, in addition to a method for performing one or more power exercises wherein such an apparatus is used.

13 Claims, 4 Drawing Sheets

APPARATUS FOR PERFORMING POWER EXERCISES

The invention relates to an apparatus for performing a power exercise by a user with the aid of one or more weights as resistance, wherein a weight comprises a weight reservoir with liquid or a fluidized substance and/or air and wherein the magnitude of the resistance is determined by the variation in the amount of liquid or a fluidized substance in the weight reservoir.

Such an apparatus is known and consists of a dumbbell which is manufactured from vinyl. This dumbbell can be filled with water. The quantity of water in the dumbbell determines the weight and therefore the resistance for the power exercise. Filling or emptying of the dumbbell is only possible when the power exercise is ceased. Apparatuses are also known under the name barbells which create the weight resistance for the power exercises by means of a number of steel weight plates, each having a fixed weight of usually 5 kg. These are stacked on top of each other and can move in a vertical path by means of a conducting system. These weight plates can be selected per number by means of a selection pin, in order to obtain the correct resistance. The selected number of plates is pulled upward during the power exercise by means of a cable which runs over one or more cable pulleys, and the other end of which is coupled to a power exercise apparatus on which the relevant exercise takes place. Selection of the weight can only take place when the exercise is ceased. It is not possible to adjust an increase in resistance smaller than the weight of one plate and the barbell system cannot be applied on separate barbells. Apparatuses are further known which create the resistance for the power exercises by means of pneumatic, electromagnetic or hydraulic systems, such as known from European patent document EP 0198746. These systems can be adjusted during the power exercise but, since they do not make use of weight, make too many concessions in the quality of the power exercises. Electromagnetic, pneumatic and hydraulic systems can furthermore not be applied to free weights such as dumbbells and the like.

The invention has for its object to obtain an apparatus which meets the following preconditions:

- The resistance for the exercise must be created by means of weight.
- This weight must be continuously adjustable.
- The system must be applicable to both machines and individual weights such as dumbbells and the like.
- During the exercise it must be easy to adjust the weight higher or lower for the person doing the exercise and/or another person or system.

According to the invention these points of departure can be fulfilled by means of a reservoir which, at least during use, contains liquid and/or air. This reservoir, which is designated as weight reservoir in the present application, serves as weight resistance for a power exercise and is connected to a liquid displacing device by means of a flexible liquid conduit. This liquid displacing device can carry liquid into and remove it from the weight reservoir whereby the weight of the weight reservoir, and therefore the resistance for the power exercise, becomes greater or smaller. Operation of this liquid displacing device can be carried out by the user while performing the power exercise.

The present invention therefore provides an apparatus of the type stated in the preamble which fulfils these preconditions, characterized in that a resistance mechanism for operating at least by the user at least while performing the power exercise and comprising a buffer tank with liquid or a fluidized substance and/or air in communication with the weight reservoir determines the magnitude of the resistance of the power exercise.

The resistance mechanism preferably comprises a pumping device with which, during suitable switch-on thereof, the magnitude of the resistance is increased in that liquid is pumped out of the buffer tank into the weight reservoir. More preferably the resistance mechanism also comprises a pumping device with which, during suitable switch-on thereof, the magnitude of the resistance is reduced in that liquid is pumped out of the weight reservoir into the buffer tank. The water present in the system is then carried in two directions and does not have to circulate.

It is also advantageous when the buffer tank is situated under the weight reservoir, which comprises a control valve on the underside, whereby upon opening thereof the magnitude of the resistance is reduced in that liquid flows out of the weight reservoir into the buffer tank under the influence of gravity.

According to a particular embodiment the buffer tank comprises a stroke-making piston which mutually separates parts with air and liquid in the buffer tank and wherein the part with liquid is connected to the weight reservoir. A further aspect of the present invention forms the buffer tank suitable for application in this particular embodiment of the apparatus, preferably taking the form of an injection syringe and having a height dimension of about 1 m to 2 m at a diameter of about 25 cm to 35 cm, more preferably a height of about 1.4 m at a diameter of about 30 cm. The magnitude of the resistance is preferably increased when the stroke-making piston is switched on in a manner such that the liquid present in the buffer tank is pressed in the direction of the weight reservoir. In further preference the magnitude of the resistance is also reduced when the stroke-making piston is switched on in a manner such that liquid is drawn out of the weight reservoir in the direction of the buffer tank. The stroke-making piston is driven using a motor. In a particular embodiment the resistance mechanism comprises a second buffer tank at least almost identical to the first and connected to a second weight reservoir at least almost identical to the first, wherein both pistons are driven in at least almost identical manner. In a particular embodiment each resistance mechanism comprises a second buffer tank at least almost identical to the first and connected to a second weight reservoir at least almost identical to the first, wherein both pistons are driven in at least almost identical manner. Each weight reservoir preferably comprises a stroke-making piston.

In a further preferred embodiment of the apparatus for performing of a plurality of power exercises by diverse users, the resistance mechanisms to be operated by the users comprise a common buffer tank in communication with several weight reservoirs. This applies for the embodiment wherein the resistance mechanism comprises a pumping device as well as for the embodiment wherein the buffer tank comprises a stroke-making piston.

For both these preferred embodiments it is preferable that either a transmission system such as for instance a cable or belt connects the weight of at least one weight reservoir as resistance to the corresponding power exercise or that at least one weight reservoir at least almost directly forms the magnitude of the resistance of the power exercise. A further aspect of the present invention is formed by a dumbbell suitable for application in this latter apparatus, wherein the dumbbell comprises two weight reservoirs which are at least almost cylindrical and which each comprise a stroke-making piston separating a part with liquid from a part with air, and which are connected by a dumbbell bar. In further preference both pistons comprise a gear rack which runs parallel to the dumbbell bar and engages in a toothed wheel mounted at least almost in the middle of the hollow dumbbell bar. In a further preferred embodiment of these two preferred embodiments at least one weight reservoir forms at least almost directly the magnitude of the resistance of the power exercise. At least one weight reservoir is preferably at least almost cylindrical. In another embodiment the resistance mechanism comprises two weight reservoirs which are at least almost cylindrical and which each comprise a stroke-making piston, connected by a dumbbell bar wherein the centre line of the dumbbell bar corresponds with the centre line of the weight reservoirs. Both pistons preferably comprise a gear rack which runs parallel to the dumbbell bar and engages in a toothed wheel mounted at least almost in the middle of the hollow dumbbell bar.

Finally, an aspect of the present invention is formed by a method for performing one or more power exercises wherein an apparatus according to the invention is applied.

It is further noted that an important part of applying the apparatus according to the invention is that the weight can be adjusted during performing of the power exercise since the final repetitions of a power exercise are the repetitions ensuring training progress. When these final repetitions cannot be performed due to exhaustion, the weight can be decreased with an apparatus according to the invention without stopping the exercise and the intended number of repetitions can still be performed, whereby stamina is also increased. This also enhances safety.

The invention will be further elucidated hereinbelow on the basis of three schematic embodiments of the apparatus according to the invention shown in the figures, although the scope of the invention should not be deemed as being limited hereto.

Figure 3A:
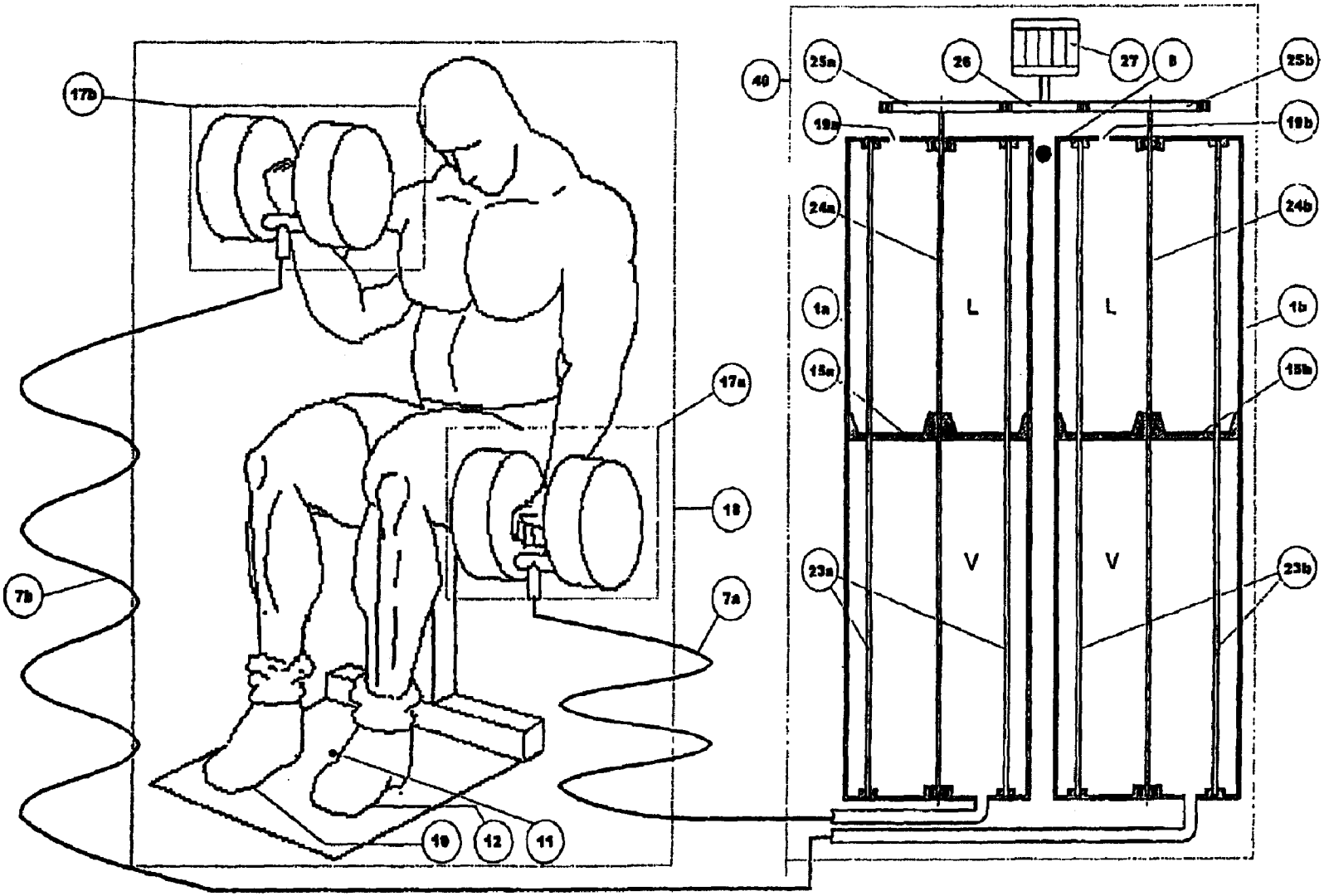
Figure 3B:
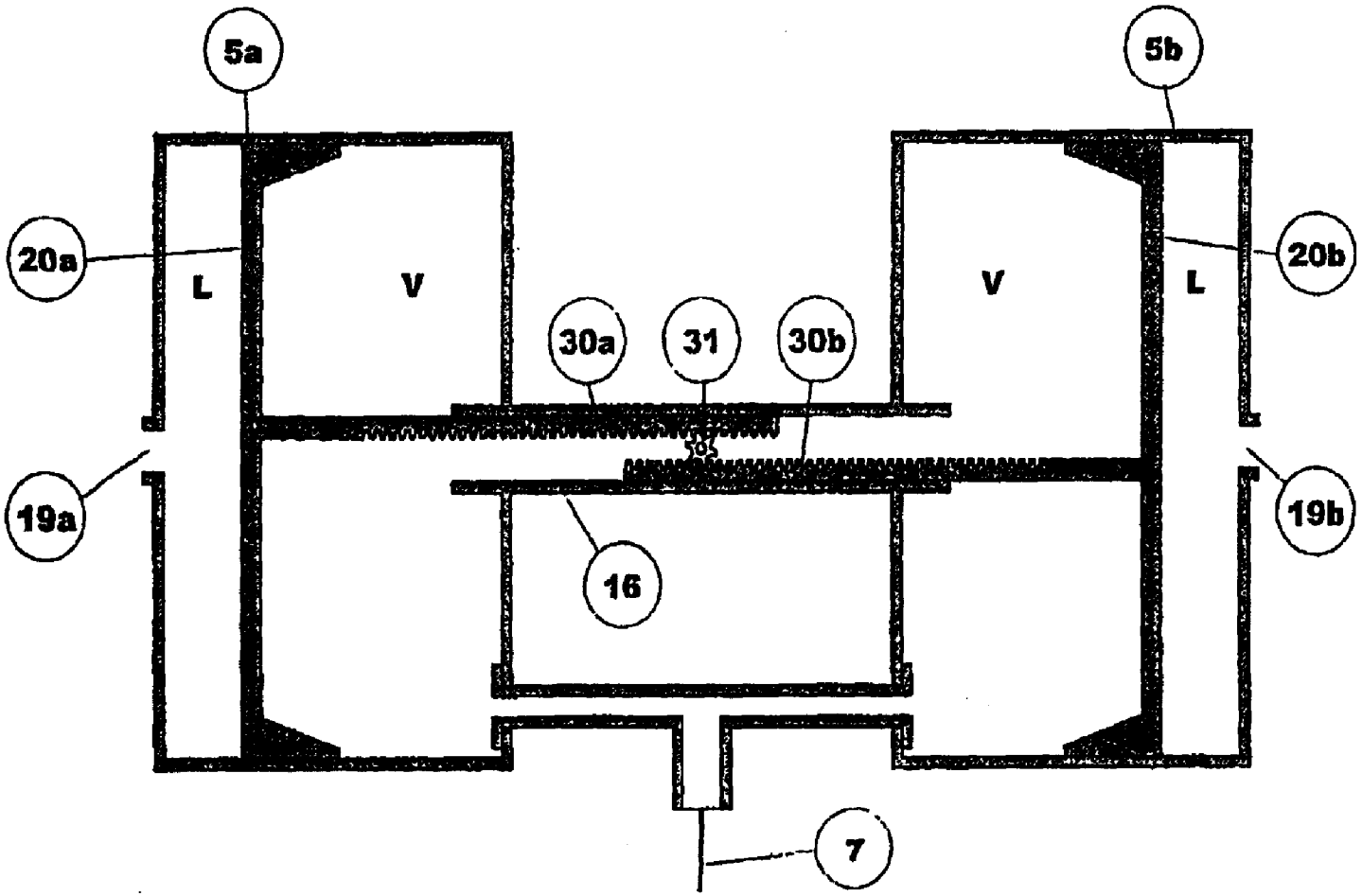

FIGS. 3*a* and 3*b* show schematically an embodiment according to the invention applied to a power exercise 18, also designated as dumbbell curl, wherein two separate dumbbells are used.

The figures are schematic and not drawn to scale. Some dimensions in particular have been exaggerated for the sake of clarity.

Figure 1:
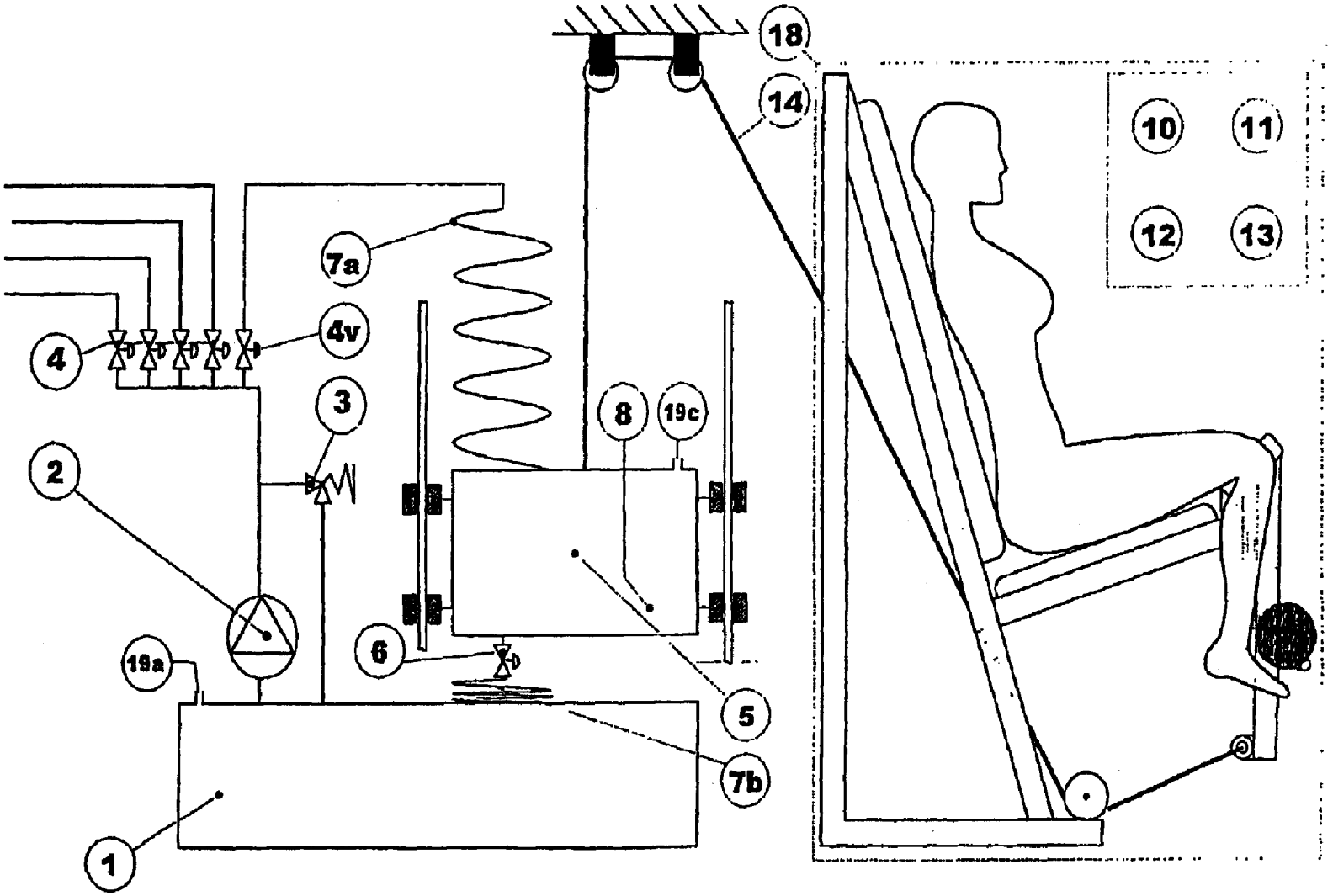
FIG. 1 shows schematically an embodiment of the apparatus according to the invention applied in a power exercise machine, also designated as "leg extension", wherein the transmission of the resistance takes place by means of a cable, comparable to the barbell system.

The apparatus which is shown schematically in FIG. 1 consists of a power exercise machine 18 ("leg extension") which is coupled to weight reservoir 5 by means of a cable 14. In this exercise the feet must be placed behind a lever in order to set this lever into motion by extending and then bending the legs again, whereby by means of the cable 14 running over cable pulleys the weight reservoir and its content are set into motion, thus providing weight resistance. Placed under weight reservoir 5 is a buffer tank 1 filled with liquid which is connected to the suction side of a liquid pump 2 connected with the pressure side to overpressure valve 3 and to control valves 4 and 4*v*. When the user takes up position on power exercise machine 18 this is sensed by means of a sensor 13 (not further shown), whereby liquid pump 2 is set into operation. Liquid pump 2 now pumps liquid out of buffer tank 1 to control valves 4 and 4*v* and to overpressure valve 3. When control valves 4 and 4*v* are closed the pressure on the pressure side of liquid pump 2 will rise to a pressure at which overpressure valve 3, which is connected with its outlet to buffer tank 1, opens, whereby the liquid flows back into buffer tank 1 and circulation thus results. When the user activates the weight resistance-increasing control 10 (not further shown), control valve 4*v* opens whereby the pressure on the pressure side of liquid pump 2 falls and overpressure valve 3 closes. The liquid is now pumped through the opened control valve 4*v* into weight reservoir 5 via flexible liquid conduit 7*a*. Weight reservoir 5 hereby becomes heavier and the resistance for the power exercise thus becomes higher. When the user activates the weight resistance-decreasing control 11 (not further shown), control valve 6 then opens whereby the liquid in weight reservoir 5, owing to the influence of gravity on this liquid, flows through the opened control valve 6 back into buffer tank 1 via flexible liquid conduit 7*b*. Weight reservoir 5 thus becomes lighter and the weight resistance for the power exercise becomes lower. During decreasing and increasing of the weight resistance of the power exercise the air can flow freely via air ports 19*a* respectively 19*c* into and out of the weight reservoir and out of and into buffer tank 1. Control valves 4 are each connected to one of the four weight reservoirs (not further shown) which are identical to weight reservoir 5 and function in identical manner and which are placed above buffer tank 1, so that a plurality of power exercise devices can be connected to and used simultaneously on one apparatus according to the invention.

It is noted that increasing and decreasing of the weight resistance for the power exercise by means of resistance-increasing control 10 and resistance-decreasing control 11 can be carried out during performing of the power exercise since weight reservoir 5 is connected over its whole range of movement to the two flexible liquid conduits 7*a* and 7*b*, whereby filling with liquid and removal of liquid remains possible. The amount of liquid in weight reservoir 5 is measured by means of a sensor 8 (not further shown) and shown on a display screen 12 in a manner such that the user can read the weight resistance before, during and after the exercise.

Figure 2:
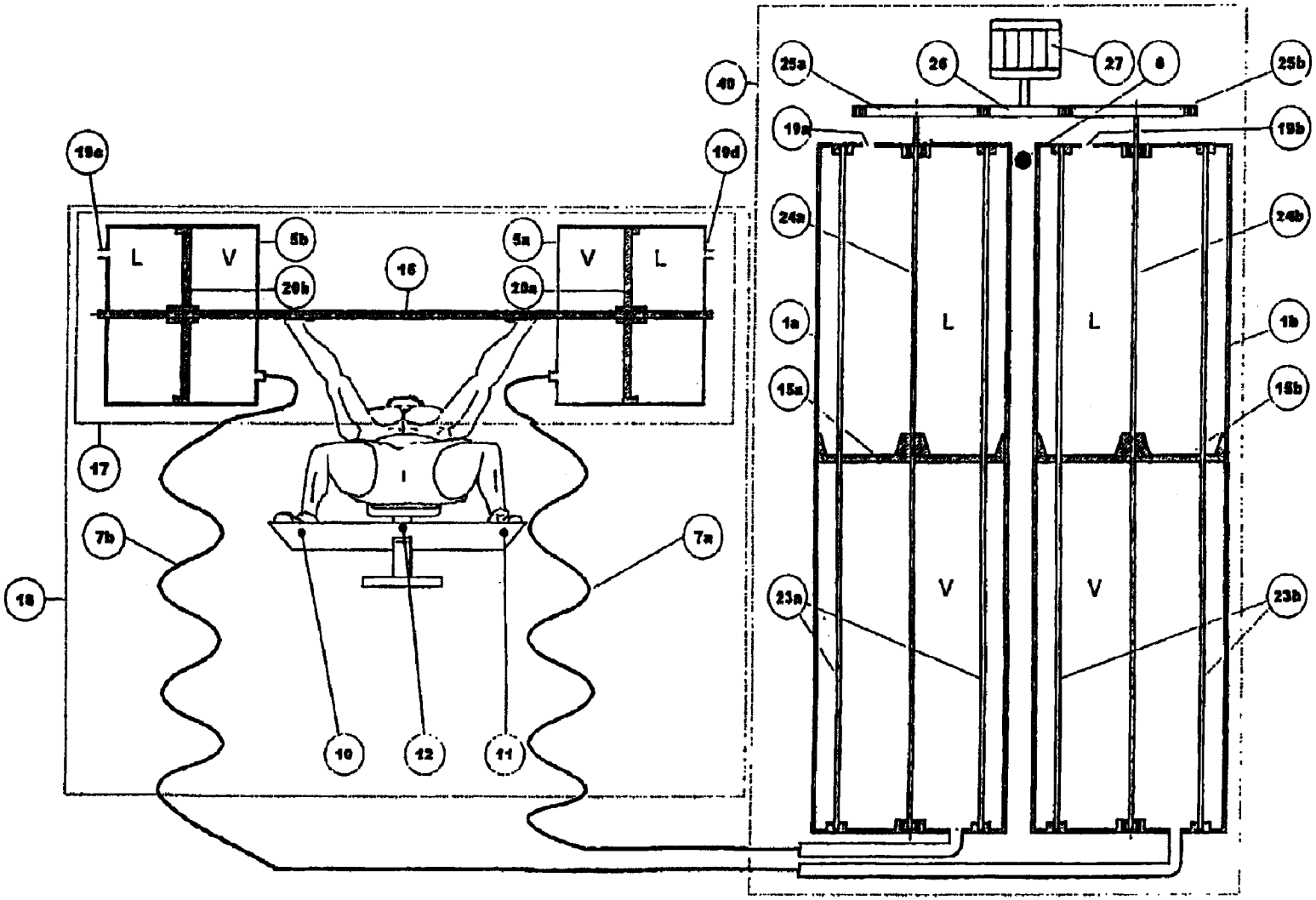
FIG. 2 shows schematically an embodiment of the apparatus according to the invention applied in a power exercise bench press wherein a separate dumbbell is used.

The apparatus shown schematically in FIG. 2 consists of a power exercise apparatus 18 (free bench presses) wherein the weight resistance, which is brought about by the weight of dumbbell 17 and its content, is transmitted directly and without conduction to the user via dumbbell bar 16. In this exercise the dumbbell has to be lowered in a vertical path to the chest, whereafter the dumbbell has to be pushed out with force. The apparatus is provided with two adjacently placed cylindrical buffer tanks 1*a* and 1*b* with centre lines extending parallel to each other and each being provided with a piston 15*a* 15*b*. Pistons 15*a* and 15*b* are provided in the middle with a hole which is equipped with internal conducting wire (not further shown) and in which a conducting wire end 24*a* respectively 24*b* is placed. Conducting wire ends 24*a* and 24*b* come from the underside of cylindrical buffer tanks 1*a* respectively 1*b* and extend, each with its centre line parallel to the centre line of the associated cylindrical buffer tank, to a position above the top of cylindrical buffer tanks 1*a* respectively 1*b*. Conducting wire ends 24*a* and 24*b* are provided with bearings on the underside and on the upper side of the cylindrical buffer tanks 1*a* and 1*b* in a manner enabling the conducting wire ends 24*a* and 24*b* to rotate on their longitudinal axis. Both the conducting wire ends 24*a* and 24*b* are each coupled with their upper end to a toothed wheel 25*a* respectively 25*b*. Toothed wheels 25*a* and 25*b* are identical. Between the two toothed wheels 25*a* and 25*b* is mounted a farther toothed wheel 26 which engages in both toothed wheels 25*a* and 25*b* and which is driven by an electric motor 27. Both pistons 15*a* and 15*b* are provided with two further holes, wherein in each of these holes is placed a conducting rod coming from the underside of the relevant cylindrical buffer tank and extending to the upper side of the relevant cylindrical buffer tank parallel to the conducting wire ends, along which rod the associated piston can make a stroke without rotating on its axis. Both pistons 15*a* and 15*b* are provided with seals (not further shown) in a manner such that the air present in chambers L is separated from the liquid present in chambers V in all possible situations lying within the function of this apparatus. By means of flexible liquid conduit 7*a* the liquid in chamber V of cylindrical buffer tank 1*a* is in direct contact with the liquid in chamber V of cylindrical weight reservoir 5*a*. By means of flexible liquid conduit 7*b* the liquid in chamber V of cylindrical buffer tank 1*b* is likewise in direct contact with the liquid in chamber V of cylindrical weight reservoir 5*b*.

Dumbbell 17 consists of a dumbbell bar 16 with a cylindrical weight reservoir 5*a* and 5*b* mounted on both ends, wherein the centre line of dumbbell bar 16 is also the centre line of weight reservoirs 5*a* and 5*b*. Weight reservoirs 5*a* and 5*b* are both provided with a piston 20*a* respectively 20*b*. Pistons 20*a* and 20*b* can make a stroke in cylindrical weight reservoirs 5*a* respectively 5*b*, wherein dumbbell bar 16 functions as conducting rod. Both pistons 20*a* and 20*b* are provided with seals (not further shown) in a manner such that the air present in chambers L of weight reservoirs 5*a* and 5*b* is separated from the liquid present in chambers V of weight reservoirs 5*a* and 5*b* in all possible situations lying within the function of this apparatus.

It is noted that the air can flow freely in and out of chambers L via air ports 19*a*, 19*b*, 19*c* and 19*d*.

When the user activates weight resistance-increasing control 10 (not further shown), electric motor 27 is then set into operation in a manner whereby toothed wheel 26 drives the two toothed wheels 25*a* and 25*b*, so that both conducting wire ends 24*a* and 24*b* rotate in the direction of rotation which ensures that both pistons 15*a* and 15*b* simultaneously make a downward stroke. The pressure in chambers V hereby becomes higher than the pressure in chambers L, whereby the liquid is pressed out of cylindrical buffer tanks 1*a* and 1*b* into weight reservoirs 5*a* and 5*b* via flexible liquid conduits 7*a* and 7*b*, with the result that pistons 20*a* and 20*b* move away from each other simultaneously. Weight reservoirs 5*a* and 5*b*, and therefore dumbbell 17, hereby become heavier, whereby the weight resistance for the power exercises increases. When the user activates weight resistance-decreasing control 11 (not further shown), electric motor 27 is then set into operation in a manner such that toothed wheel 26 thereby drives the two toothed wheels 25*a* and 25*b*, so that both conducting wire ends 24*a* and 24*b* rotate in the direction of rotation which ensures that both pistons 15*a* and 15*b* simultaneously make an upward stroke. The pressure in chambers V hereby becomes lower than the pressure in chambers L, whereby the liquid is pressed out of weight reservoirs 5*a* and 5*b* into buffer tanks 1*a* and 1*b* via flexible liquid conduits 7*a* and 7*b* respectively, with the result that pistons 20*a* and 20*b* move toward each other simultaneously. Weight reservoirs 5*a* and 5*b*, and therefore dumbbell 17, hereby become lighter, whereby the resistance for the power exercises becomes lower. It is noted that by means of the simultaneous stroke-making pistons 15*a* and 15*b* the weight reservoirs 5*a* and 5*b* contain an equal amount of liquid in all possible situations lying within the function of this apparatus, so that dumbbell 17 remains in balance.

It is also noted that increasing and decreasing the weight resistance for the power exercise by means of the weight resistance-increasing control 10 and the weight resistance-decreasing control 11 can be carried out while the power exercise is being performed, since weight reservoirs 5*a* and 5*b* are connected over their whole range of movement to flexible liquid conduits 7*a* respectively 7*b*, whereby filling with liquid and removal of liquid remains possible. The amount of liquid in reservoirs 5*a* and 5*b* is measured by means of a sensor 8 (not further shown) and displayed on a display 12 (not further shown) in a manner whereby the user can read the weight resistance before, during and after the exercise.

It is also noted that the liquid displacing system 40 can also be applied to power exercise apparatus 18 ("leg extension") in FIG. 1, wherein the components in FIG. 1 with numerals 1, 2, 3, 4, 4*v*, 6, 7*a*, 7*b*, 8 and 13 are omitted. Weight reservoir 5 in FIG. 1 must be directly connected under its lowest possible liquid level to the flexible liquid conduit 7*a* shown in FIG. 2, the other end of which is directly connected to cylindrical buffer tank 1*a*. The other cylindrical buffer tank 1*b* of FIG. 2 is omitted and electric motor 27 can now be connected directly to conducting wire end 24*a* of cylindrical buffer tank 1*a*. The components of FIG. 1 with the numerals 10, 11 and 12 have the same functions in this situation as the components of FIG. 2 with the numerals 10, 11 and 12.

The apparatus shown schematically in FIG. 3A consists of a power exercise apparatus 18 ("dumbbell curl") wherein the resistance, which is brought about by means of the weight of dumbbells 17*a* and 17*b* and their content, is transmitted directly and without conduction onto the user. In this exercise the dumbbells 17*a* and 17*b* have to be moved alternately upward and downward in a round ("curl") movement using the arms. The liquid displacing system 40 is the same as the liquid displacing system 40 in FIG. 2. Operation of liquid displacing system 40 is also the same as the operation of liquid displacing system 40 in FIG. 2. Flexible liquid conduit 7*a* is connected to dumbbell 17*a* and flexible liquid conduit 7*b* is connected to dumbbell 17*b*. Dumbbells 17*a* and 17*b* are identical.

The apparatus shown schematically in FIG. 3B relates to one of the two dumbbells 17*a* and 17*b* as shown in FIG. 3A. The dumbbell consists of two cylindrical weight reservoirs 5*a* and 5*b* which are separated by a hollow dumbbell bar 16 and both contain a piston 20*a* respectively 20*b*. Both pistons 20*a* and 20*b* are provided with a gear rack 30*a* respectively 30*b* extending parallel to the centre line of the hollow dumbbell bar 16 and to the middle of hollow dumbbell bar 16, both of which racks engage in one toothed wheel 31 rotating on an axis mounted in the middle of hollow dumbbell bar 16. Both pistons 20*a* and 20*b* are provided with seals (not further shown) in a manner such that the air present in chambers L is separated at all times from the liquid present in chambers V. When liquid flows into chambers V via flexible liquid conduit 7 by means of a pressure difference, this liquid then presses pistons 20*a* and 20*b* apart whereby gear racks 30*a* and 30*b* drive toothed wheel 31. When liquid flows out of chambers V via flexible liquid conduit 7 by means of a pressure difference, the atmospheric pressure in chambers L then presses pistons 20*a* and 20*b* toward each other, whereby gear racks 30*a* and 30*b* drive toothed wheel 31. In all possible situations lying within the function of this apparatus, the toothed wheel 31 prevents the stroke movements of the pistons differing from each other due to possible pressure differences in chambers L and/or V.

It is noted that weight resistance-increasing control 10, the weight resistance-decreasing control 11, sensor 8, display 12 and sensor 13 are not shown in the figures since different technical applications are already known for these devices in measuring and control engineering.

It is also rioted that separating air and liquid by means of pistons 20*a* and 20*b* in weight reservoirs 5*a* and 5*b*, which are shown in FIGS. 2 and 3B, prevents the liquid being set into motion such that the centre of gravity of dumbbells 17, 17*a* and 17*b* becomes unstable.

What is claimed is:

1. Apparatus for performing a power exercise by a user with the aid of one or more weights as resistance, wherein a weight comprises a weight reservoir with liquid or a fluidized substance and/or air and wherein the magnitude of the resistance is determined by the variation in the amount of liquid or a fluidized substance in the weight reservoir wherein a resistance mechanism for operating at least by the user at least while performing the power exercise and comprising a buffer tank with liquid or a fluidized substance and/or air in communication with the weight reservoir determines the magnitude of the resistance of the power exercise characterized in that the buffer tank comprises a stroke-making piston which mutually separates parts with air and liquid in the buffer tank and wherein the part with liquid is connected to the weight reservoir.

2. Apparatus according to claim 1, wherein the magnitude of the resistance is increased when the stroke-making piston is switched on in a manner such that the liquid present in the buffer tank is pressed in the direction of the weight reservoir.

3. Apparatus according to claim 1, wherein the magnitude of the resistance is reduced when the stroke-making piston is switched on in a manner such that liquid is drawn out of the weight reservoir in the direction of the buffer tank.

4. Apparatus according to claim 2, wherein the stroke-making piston is driven using a motor.

5. Apparatus according to claim 1 for performing of a plurality of power exercises by different users, wherein the resistance mechanisms to be operated by the users comprise a common buffer tank in communication with several weight reservoirs.

6. Apparatus according to claim 1, wherein at least one weight reservoir at least almost directly forms the magnitude of the resistance of the exercise.

7. Apparatus according to claim 6, wherein at least one weight reservoir is at least almost cylindrical.

8. Apparatus according to claim 6, wherein the resistance mechanism comprises two weight reservoirs which are at least almost cylindrical and which each comprise a stroke-making piston, connected by a dumbbell bar wherein the center line of the dumbbell corresponds with the center line of the weight reservoirs.

9. Apparatus according to claim 8, wherein both pistons comprise a gear rack which runs parallel to the dumbbell bar and engages in a toothed wheel mounted at least almost in the middle of the hollow dumbbell bar.

10. Buffer tank suitable for application in an apparatus as described in claim 1, wherein the buffer tank takes the form of an injection syringe and has a height dimension of about 1 m to 2 m at a diameter of about 25 cm to 35 cm, preferably a height of about 1.4 m at a diameter of about 30 cm.

11. Dumbbell suitable for application in an apparatus as described in claim 6, wherein the dumbbell comprises two weight reservoirs which are at least almost cylindrical and which each comprise a stroke-making piston separating a part with liquid from a part with air, and which are connected by a dumbbell bar.

12. Dumbbell according to claim 11, wherein both pistons comprise a gear rack which runs parallel to the dumbbell bar and engages in a toothed wheel mounted at least almost in the middle of the hollow dumbbell bar.

13. Method of performing one or more power exercises wherein an apparatus as described in claim 1 is applied.

* * * * *